US006145413A

United States Patent [19]

Lin

[11] Patent Number: 6,145,413

[45] Date of Patent: Nov. 14, 2000

[54] MULTIFUNCTION TOOL

[76] Inventor: Ching Chou Lin, No. 150. Sec. 3 Chung San Road Wu Zh Hsiang, Taichung Hsien, Taiwan

[21] Appl. No.: 09/152,851

[22] Filed: Sep. 14, 1998

[51] Int. Cl.[7] ..... B25B 13/46

[52] U.S. Cl. ..... 81/63.1; 81/58.4; 81/61; 81/177.7; 81/177.6; 81/177.2; 81/62

[58] Field of Search ..... 81/63.1, 61, 62, 81/58.4, 29, 32, 33, 177.8–177.9

[56] References Cited

U.S. PATENT DOCUMENTS

| | | | |
|---|---|---|---|
| 344,160 | 6/1886 | Brwonson . | |
| 1,563,178 | 11/1925 | Fegley et al. . | |
| 1,712,196 | 5/1929 | Burger et al. . | |
| 2,304,271 | 12/1942 | Merriman et al. . | |
| 2,503,373 | 4/1950 | Browning et al. | 81/177.7 |
| 3,177,910 | 4/1965 | Silva | 81/61 |
| 3,191,466 | 6/1965 | Kawashima | 81/32 |
| 3,739,825 | 6/1973 | Knox . | |
| 3,901,298 | 8/1975 | Eby . | |
| 4,334,445 | 6/1982 | Timewell | 81/177.8 |
| 4,736,658 | 4/1988 | Jore . | |
| 4,787,278 | 11/1988 | Bononi . | |
| 5,211,086 | 5/1993 | Shu . | |
| 5,351,586 | 10/1994 | Habermehl et al. . | |
| 5,651,294 | 7/1997 | Shiao | 81/63.1 |
| 5,687,820 | 11/1997 | Lin | 81/63.1 |
| 5,797,300 | 8/1998 | Fairsbanks | 81/177.7 |
| 5,806,381 | 9/1998 | Lin | 81/58.4 |

*Primary Examiner*—James G. Smith
*Assistant Examiner*—Lee Wilson
*Attorney, Agent, or Firm*—Charles E. Baxley, Esq.

[57] ABSTRACT

A tool includes a handle having a bore for slidably receiving a stop and a link. The link has one end pivotally coupled to the stop for allowing the link to be rotated relative to the stop when the link is extended outward of the handle. A driving stem is pivotally coupled to the link for allowing the driving stem to be rotated relative to the link when the link is extended outward of the handle. A ratchet mechanism is disposed in the handle and is selectively engaged with the stop for controlling the driving direction of the driving stem.

9 Claims, 8 Drawing Sheets

MULTIFUNCTION TOOL

BACKGROUND OF THE INVENTION

1. Field of the Invention

The present invention relates to a tool, and more particularly to a nultifunction tool.

2. Description of the Prior Art

Typical tools, such as screw drivers, comprise a driving stem for engaging with and for driving fasteners. Some of the tools may include a retractable member provided in the rear portion of the handle for forming a L-shaped handle bar for the tool when the retractable member is extended outward of the handle. This kind of tools may not include a ratchet mechanism for controlling the driving direction of the tool.

The present invention has arisen to mitigate and/or obviate the afore-described disadvantages of the conventional tools.

SUMMARY OF THE INVENTION

The primary objective of the present invention is to provide a tool that may be converted to an L-shaped tool and a tool having a rotatable handle.

In accordance with one aspect of the invention, there is provided a tool comprising a handle including a bore formed therein and including a first end and a second end, a stop slidably engaged in the bore of the handle, a link slidably received in the bore of the handle and including a first end pivotally coupled to the stop for allowing the link to be rotated relative to the stop when the link is extended outward of the handle, the link including a second end, a driving stem including a first end pivotally coupled to the second end of the link for allowing the driving stem to be rotated relative to the link when the second end of the link is extended outward of the handle, and a ratchet means for controlling a driving direction of the driving stem.

A positioning means is further provided for positioning the driving stem relative to the link at a selected angular position, and for positioning the link relative to the stop at a selected angular position. A positioning means is provided for positioning the stop to the handle and for positioning the link to the handle. A device is further provided for preventing the stop from being disengaged from the handle.

A collar is further secured in the first end of the handle, the collar includes at least one slot formed therein, the first end of the driving stem includes at least one jut formed thereon for engaging with the at least one slot when the first end of the driving stem is engaged in the first end of the handle and for allowing the driving stem to be solidly driven by the handle.

The stop includes a stud extended therefrom, the ratchet means includes at least one gear rotatably received in the handle, a pair of pawls, means for biasing the pawls to engage with the at least one gear, and means for selectively disengaging the pawls from the at least one gear to actuate the driving stem in the driving direction.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 3:
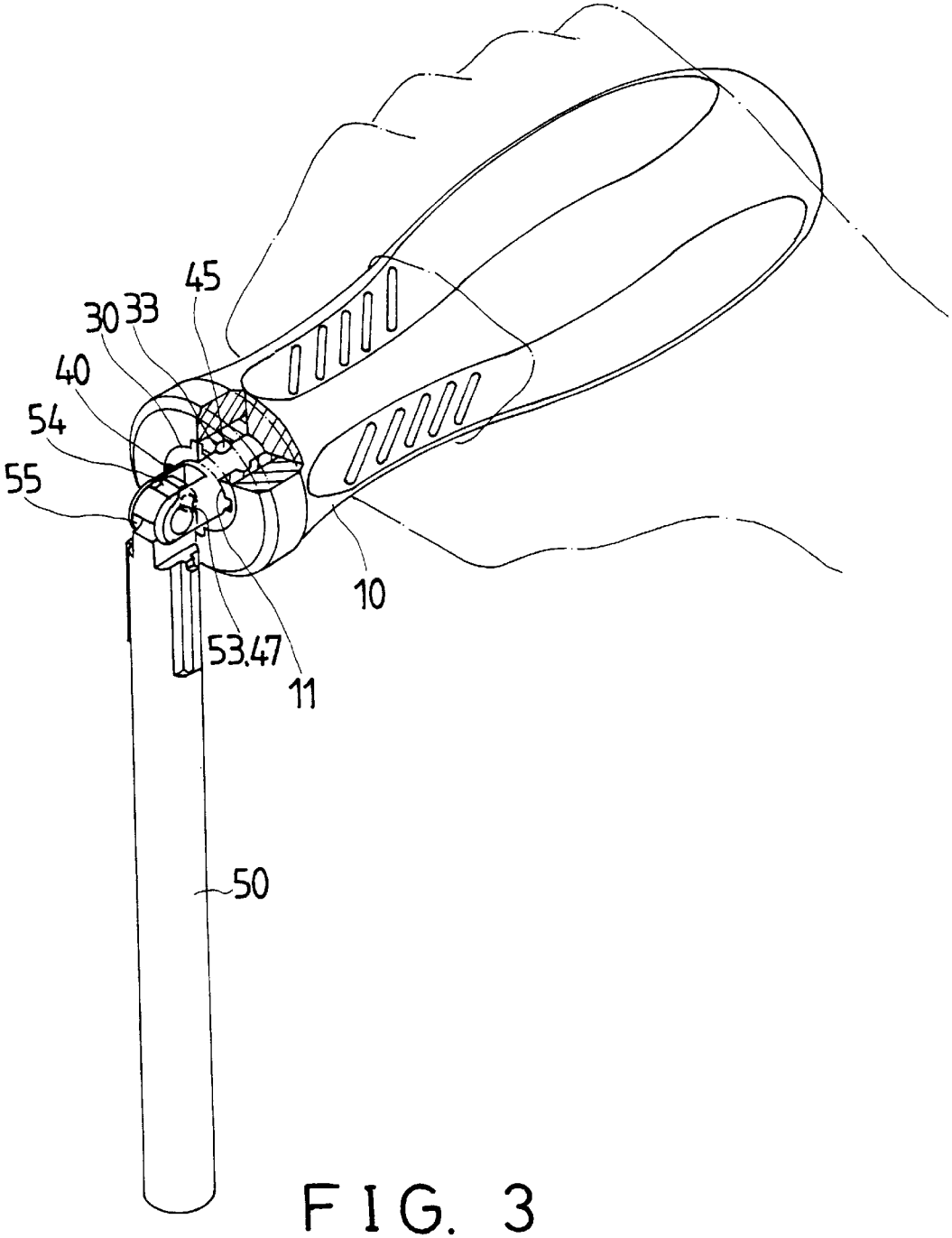
FIG. 3 is a perspective view of the tool showing the L-shaped structure of the tool.

Referring to the drawings, and initially to FIGS. 1–4, a tool in accordance with the present invention comprises a handle 10 including a bore 11 formed therein and including one or more channels 12 formed in the front portion and communicating with the bore 11. A collar 30 includes two keys 32 engaged in the channels 12 and secured to the handle 10 by such as adhesive materials, welding process or force-fitted engagement and includes a bore 31 and one or more slots 34 communicating with the bore 31 and includes an annular recess 33 formed therein. A link 40 is slidably received in the bore 11 and includes two ends each having a groove 41 formed therein for forming a bifurcated end portions and each having a hole formed through the bifurcated end portions for receiving a pin 48, and each having a cavity 42 for receiving a spring-biased projection 46, 47 respectively. The link 40 includes a spring-biased projection 45 for engaging with the annular recess 33 of the collar 30 and for positioning the link 40 relative to the handle 10 at the selected angular position (FIG. 3).

Figure 4:
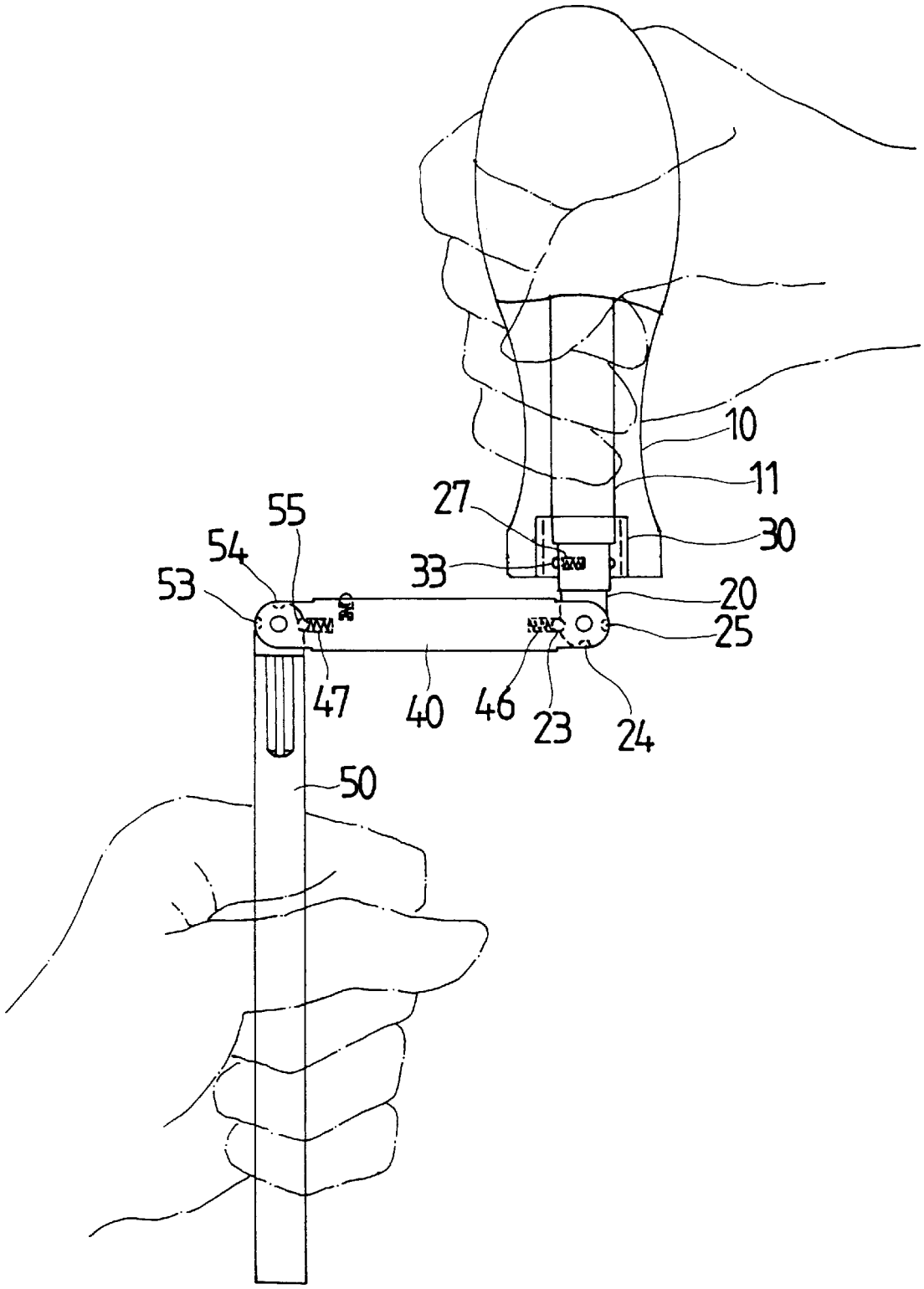
FIGS. 4, 5, 6 are schematic views illustrating the operation of the tool.

A stop 20 is slidably received in the bore 11 of the handle 10 and includes one end 21 engaged in the groove 41 of the link 40 and having a hole 22 for receiving one of the pins 48 and for allowing the link 40 to be rotated relative to the stop 20 when the link 40 is extended or pulled out of the handle 10 (FIG. 4). The one end 21 of the stop 20 includes one or more recesses 23, 24, 25 for engaging with the spring-biased projection 46 (FIG. 4) and for positioning the stop 20 relative to the link 40. The stop 20 includes an enlarged head 26 for engaging with the collar 30 and for preventing the stop 20 from being disengaged from the handle 10. The collar 30 may include a shoulder or an annular flange extended radially therein for engaging with the head 26 of the stop 20. The stop 20 includes a spring-biased projection 27 for engaging with the annular recess 33 of the collar 30 and for positioning the stop 20 relative to the handle 10 at the selected angular position (FIG. 4).

Figure 5:
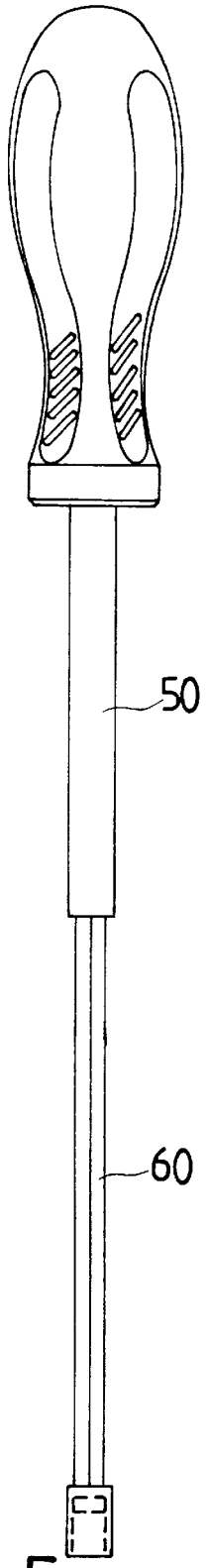
Figure 6:
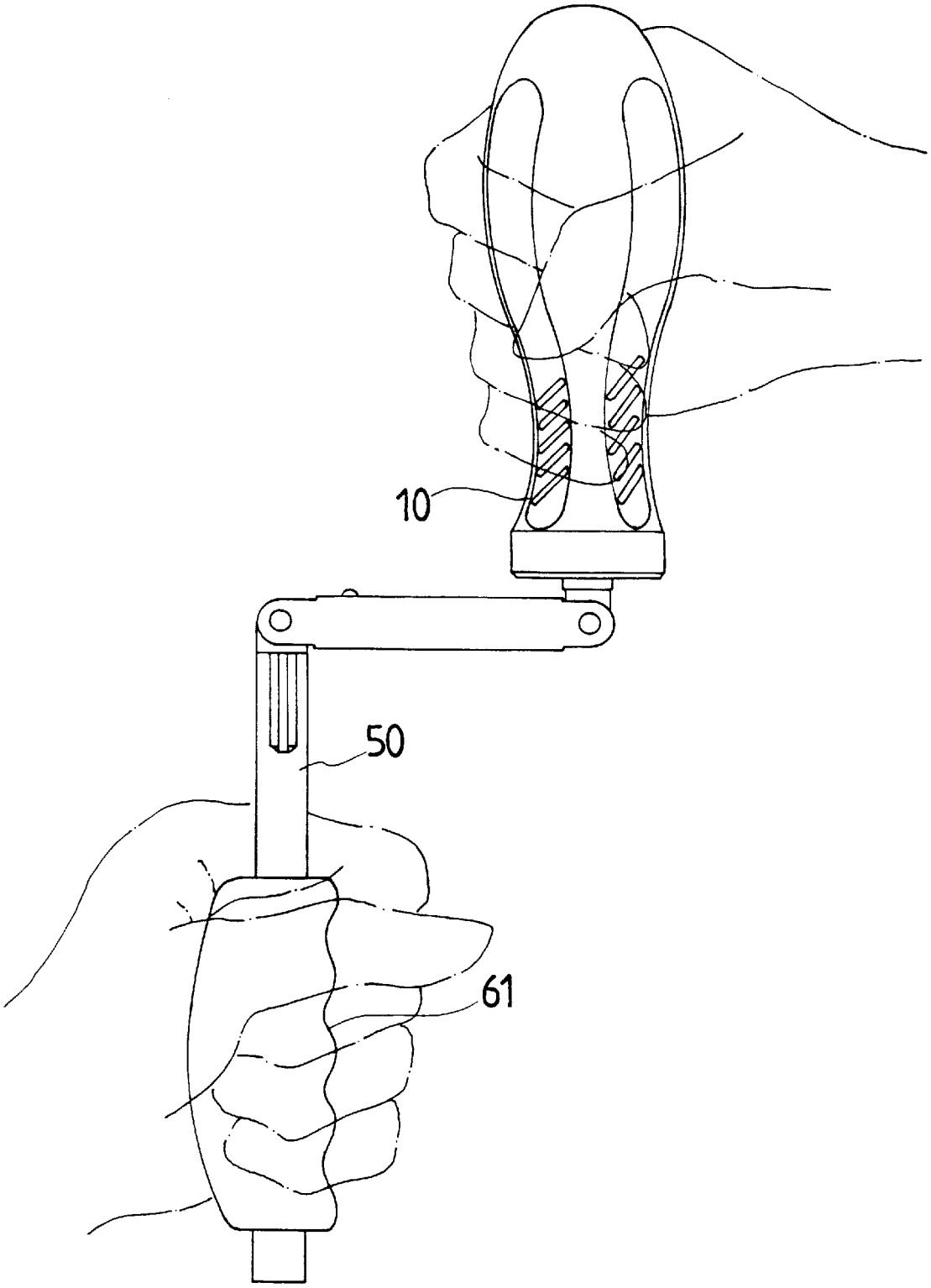

A driving stem 50 includes one end 51 engaged in the groove 41 of the link 40 and having a hole 52 for receiving one of the pins 48 and for allowing the driving stem 50 to be rotated relative to the link 40 when the outer end of the link 40 is pulled out of the handle 10 (FIGS. 3, 4). The driving stem 50 includes one or more juts 56 formed on the one end 51 for engaging with the slots 34 of the collar 30 and for allowing the driving stem 50 to be rotated by the handle 10 via the collar 30. The one end 51 of the driving stem 50 includes one or more recesses 53, 54, 55 for engaging with the spring-biased projection 47 (FIGS. 3, 4) and for positioning the driving stem 50 relative to the link 40. The driving stem 50 includes an engaging hole 57 formed in the other end for engaging with the fasteners or the tool extensions. The driving stem 50 may include a telescope tube 60 for extending the length of the driving stem 50 (FIG. 5). As shown in FIG. 6, an auxiliary hand grip 61 may be engaged on the driving stem 50 for allowing the user to rotate the driving stem 50 with a rotatable handle structure when the link 40 and the driving stem 50 are pulled outward of the handle 10.

Figure 1:
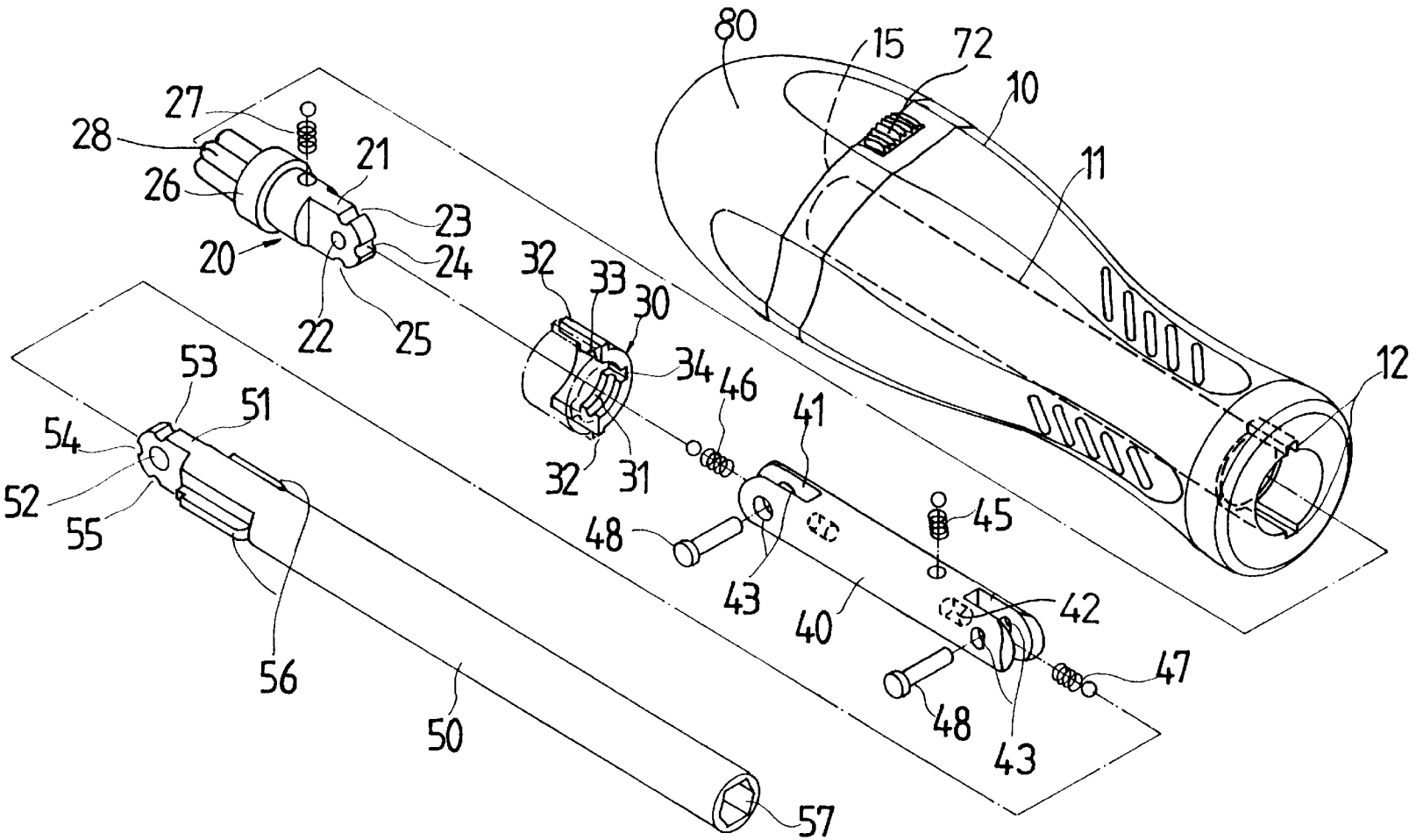
FIG. 1 is an exploded view of a tool in accordance with the present invention.
Figure 2:
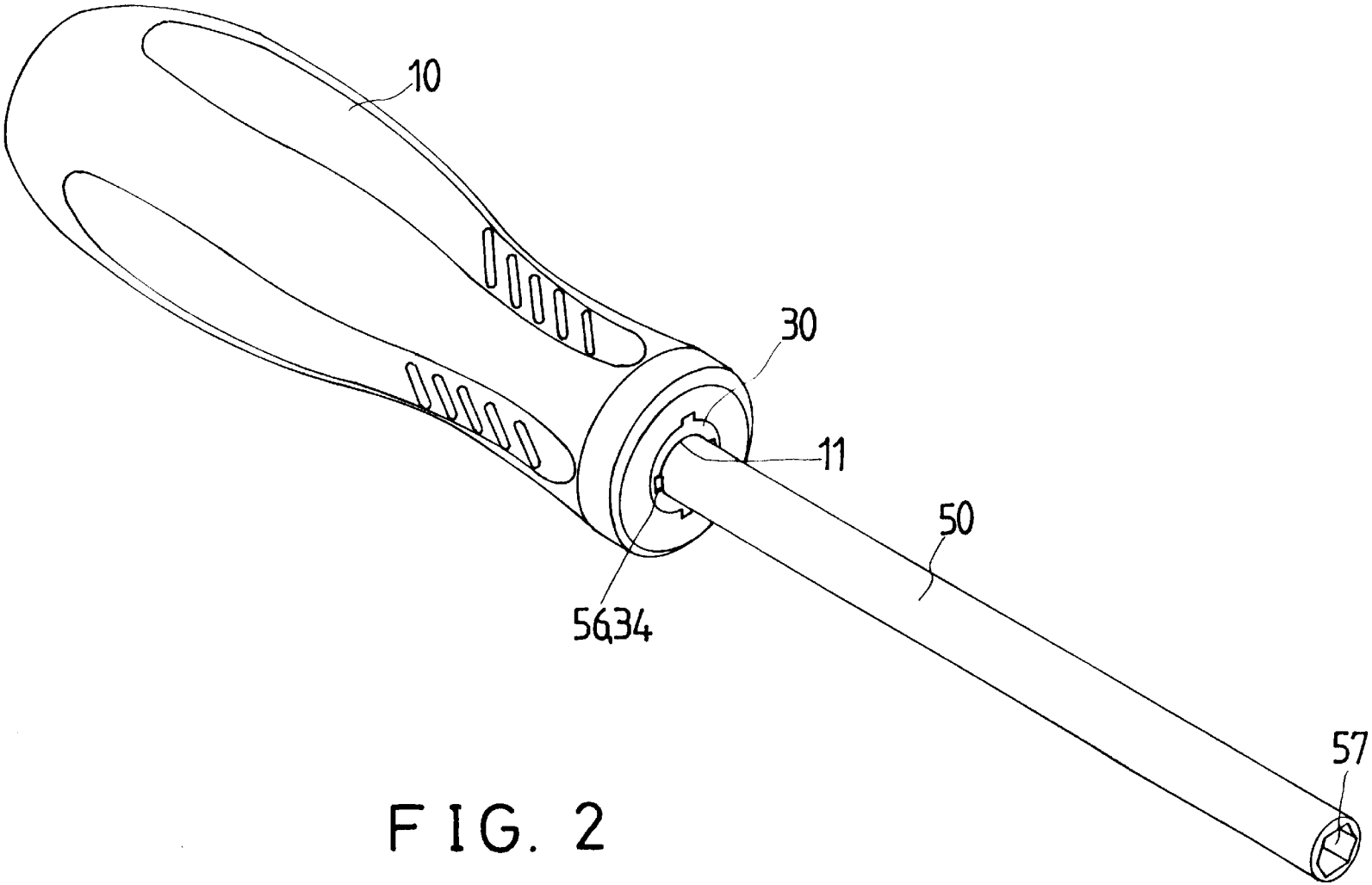
FIG. 2 is a perspective view of the tool.
Figure 9:
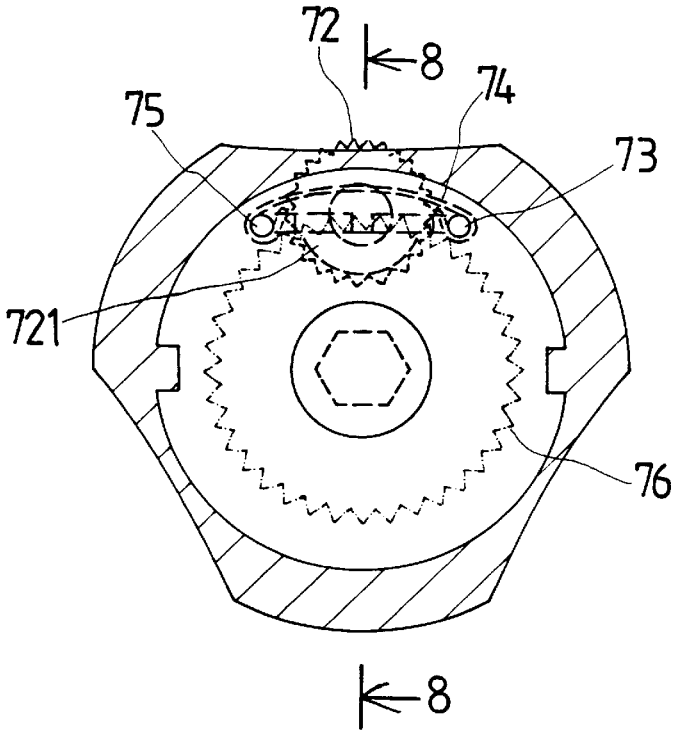
FIG. 9 is a cross sectional view taken along lines 9—9 of FIG. 8.
Figure 7:
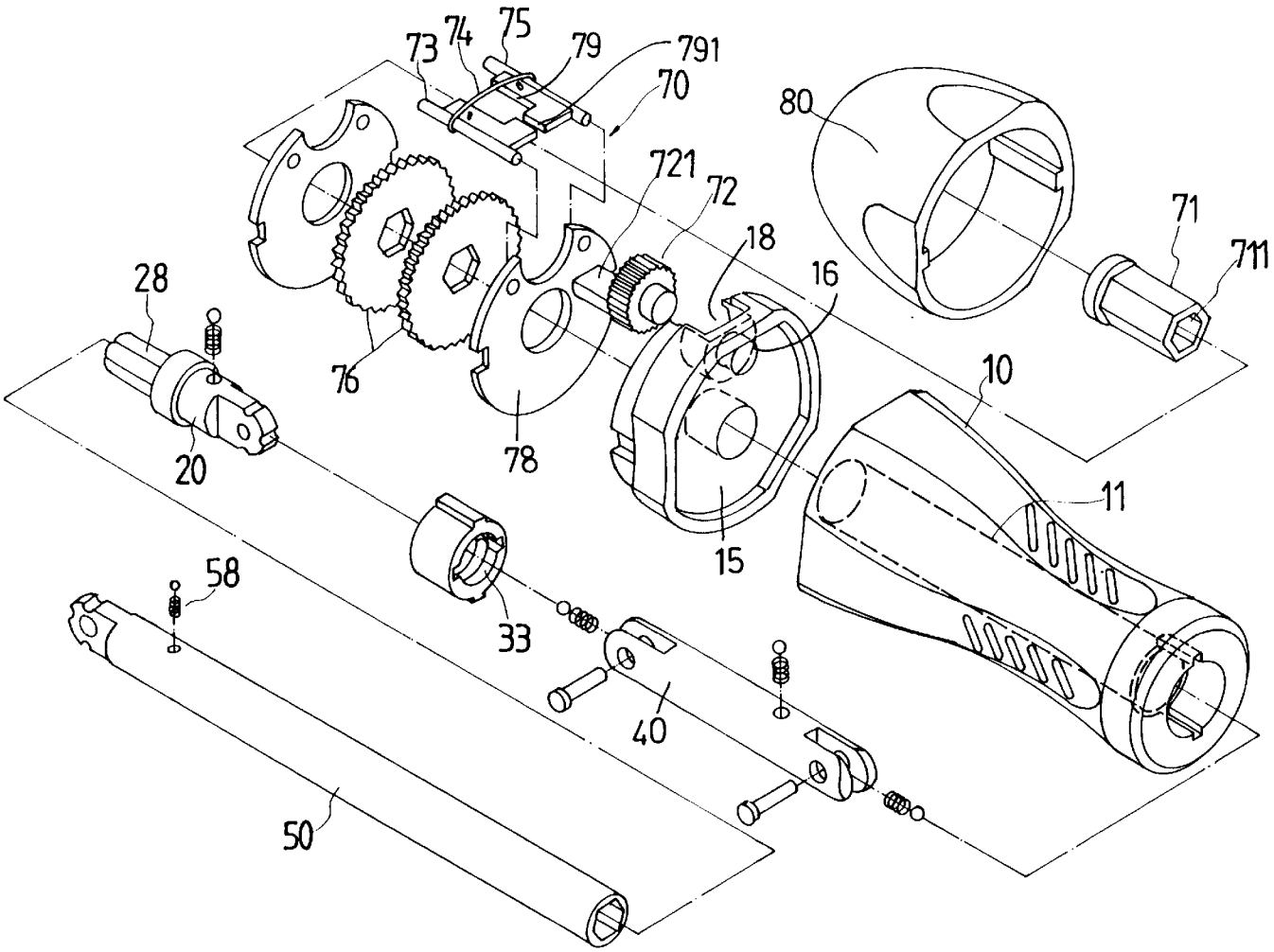
FIG. 7 is an exploded view of the tool.
Figure 8:
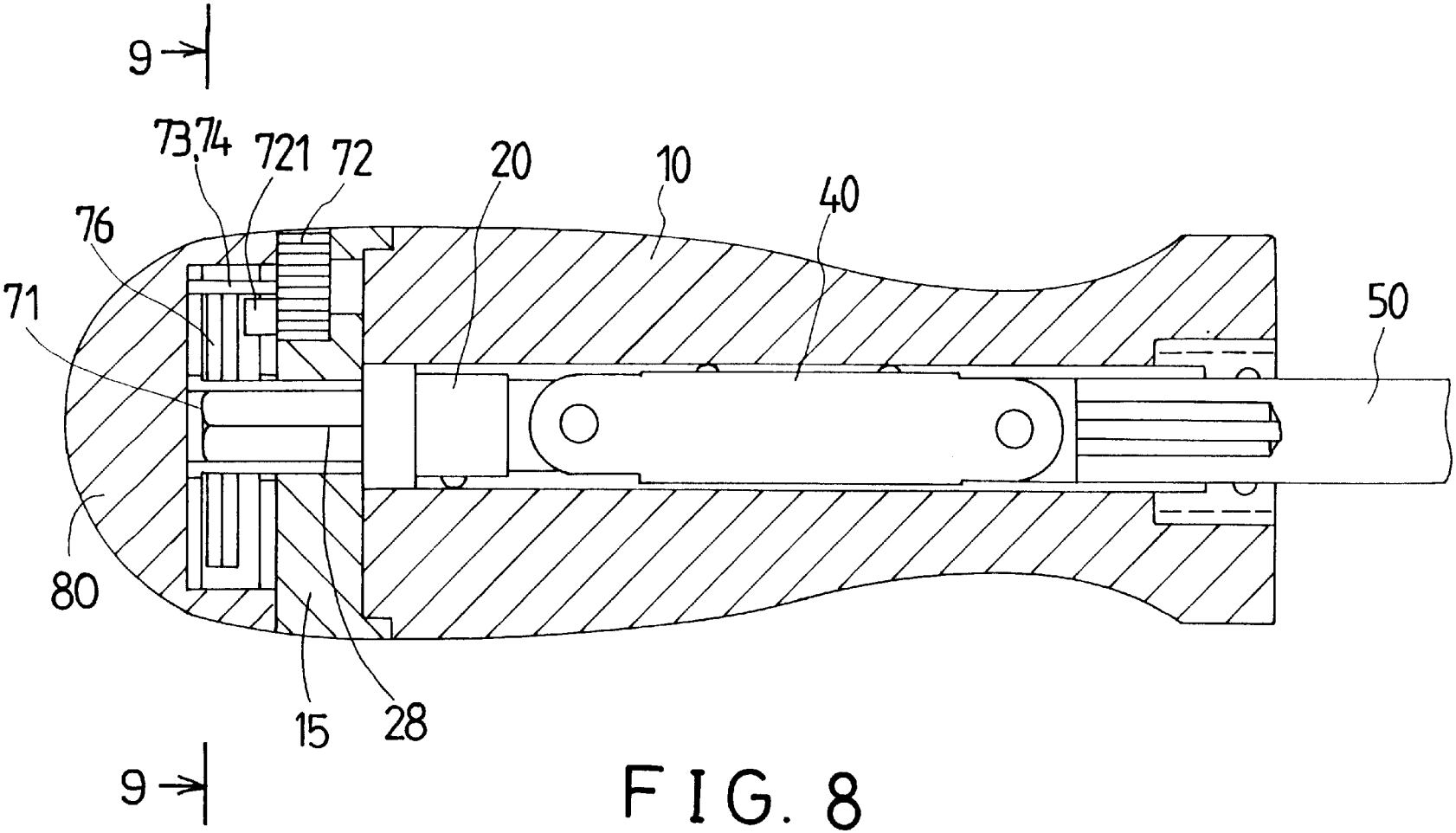
FIG. 8 is a cross sectional view taken along lines 8—8 of FIG. 9.

Referring next to FIGS. 7–9, a board 15 and a cap 80 are secured to the rear end of the handle 10 for receiving a ratchet mechanism 70. The board 15 includes a depression 18 for rotatably receiving a knob 72 and includes an opening 18 for partially exposing the knob 72 and for allowing the knob 72 to be rotated by the user (FIGS. 1, 8, 9). The knob 72 includes an actuator 721 extended away from the board 15 and extended inward of the cap 80. The ratchet mechanism 70 includes one or more gears 76 disposed between two discs 78, and two pawls 73, 75 rotatably secured between the discs 78. A spring. The pawls 73, 75 each includes a pawl member 79 for engaging with the gear 76 and each includes an extension 791 for engaging with the actuator 721 and for allowing the actuator 721 to disengage either of the pawl members 79 from the gear 76. A spring 74 is engaged with the pawls 73, 75 for biasing the pawl members 79 to engage with the gear 76. A socket 71 is engaged through the gears 76 and rotated in concert with the gears 76 and includes a hole 711 formed therein. The socket 71 and the hole 711 each includes a non-circular cross section, for allowing the socket 71 to be rotated in concert with the gears 76. The stop 20 includes a stud 28 for engaging with the hole 711 of the socket 71.

In operation, when both of the pawls 73, 75 are engaged with the gear 76, the stop 20 and thus the link 40 and the driving stem 50 may be driven in both the active direction and the reverse direction by the handle 10. When one of the pawls 73, 75 is disengaged from the gears 76 by the actuator 721 when the knob 72 is rotated by the user, the driving stem 50 may thus be driven in either the active direction or the reverse direction only by the handle 10.

Accordingly, the tool in accordance with the present invention may be converted to an L-shaped tool and a tool having a rotatable handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a) a handle including a bore formed therein and including a first end and a second end;

b) a stop slidably received in said bore of said handle;

c) a link slidably received in said bore of said handle and extendible outward of said bore of said handle, said link including a first end rotatable coupled to said stop, said link being aligned with said stop when said link and said stop are received in said bore of said handle, and said link being rotatable relative to said stop when said link is extended outward of said handle, said link including a second end; and d) a driving stem including a first end rotatable coupled to said second end of said link and rotatable relative to said link when said second end of said link is extended outward of said handle, said driving stem being aligned with said link when said stop and said link and said first end of said driving stem are received in said bore of said handle, and for allowing said driving stem to be solidly driven by said handle when said first end of said driving stem is received in said bore of said handle.

2. The tool according to claim 1 further comprising ratchet means for controlling a driving direction of said driving stem.

3. The tool according to claim 1 further comprising means for positioning said driving stem relative to said link at a selected angular position.

4. The tool according to claim 1 further comprising means for positioning said link relative to said stop at a selected angular position.

5. The tool according to claim 1 further comprising means for preventing said stop from being disengaged from said handle.

6. The tool according to claim 1 further comprising means for positioning said stop to said handle.

7. The tool according to claim 1 further comprising means for positioning said link to said handle.

8. The tool according to claim 1 further comprising a collar secured in said first end of said handle, said collar including at least one slot formed therein, said first end of said driving stem including at least one jut engaged with said at least one slot when said first end of said driving stem is engaged in said first end of said handle.

9. The tool according to claim 1, wherein said stop includes a stud extended therefrom, said ratchet means includes at least one gear rotatably received in said handle, a pair of pawls, means for biasing said pawls to engage with said at least one gear, and means for selectively disengaging said pawls from said at least one gear to actuate said driving stem in the driving direction.

* * * * *